US008985122B1

(12) United States Patent
Voegeli

(10) Patent No.: US 8,985,122 B1
(45) Date of Patent: Mar. 24, 2015

(54) FINGERNAIL DECORATION KIT

(71) Applicant: Anne Marie Voegeli, McKinney, TX (US)

(72) Inventor: Anne Marie Voegeli, McKinney, TX (US)

( * ) Notice: Subject to any disclaimer, the term of this patent is extended or adjusted under 35 U.S.C. 154(b) by 0 days.

(21) Appl. No.: 14/018,188

(22) Filed: Sep. 4, 2013

Related U.S. Application Data

(60) Provisional application No. 61/697,963, filed on Sep. 7, 2012.

(51) Int. Cl.

| | |
|---|---|
| ***A45D 29/18*** | (2006.01) |
| ***A45D 29/00*** | (2006.01) |
| ***A44C 15/00*** | (2006.01) |
| ***A45D 29/02*** | (2006.01) |
| ***A45D 31/00*** | (2006.01) |

(52) U.S. Cl.

CPC ..... *A45D 29/18* (2013.01); *A44C 15/0015* (2013.01); *A44C 15/0035* (2013.01); *A44C 15/008* (2013.01); *A45D 29/02* (2013.01); *A45D 29/00* (2013.01); *A45D 31/00* (2013.01); *A45D 2029/005* (2013.01)

USPC ..... 132/73.5; 132/73

(58) Field of Classification Search

CPC . A45D 29/00; A45D 29/18; A45D 2029/005; A45D 29/02; A45D 31/00; B26F 1/32; A44C 15/0015; A44C 15/0035; A44C 15/008

USPC ..... 132/73.5, 200, 73, 75, 75.3, 75.4, 75.5; 606/117, 184, 185, 186, 188, 167; 40/301; 119/759, 866; 63/42, 12, 13, 63/14.8, 33; 29/893.33, 898.045, 896.41, 29/716, 238, 753, 10, 525.06, 525.05; D19/72; D28/52, 54, 60; 81/415, 417, 81/421, 418, 422, 423; 30/26, 28, 363; 227/67, 27, 144, 35; 7/128; 24/67 P, 24/67 R, 67.9, 705, DIG. 8; 411/502

See application file for complete search history.

(56) References Cited

U.S. PATENT DOCUMENTS

| | | | | | |
|---|---|---|---|---|---|
| 660,335 | A * | 10/1900 | Peeso | 30/363 |
| 1,320,427 | A * | 11/1919 | Spurling | 606/117 |
| 1,364,137 | A * | 1/1921 | Pannier | 606/184 |
| 1,462,202 | A * | 7/1923 | Hopper | 606/184 |
| 1,482,290 | A * | 1/1924 | Elzi | 72/409.02 |
| 1,489,558 | A * | 4/1924 | Timson | 606/116 |
| 2,078,827 | A * | 4/1937 | Ashton | 40/302 |
| 2,192,699 | A * | 3/1940 | Storz | 606/166 |
| 3,519,188 | A * | 7/1970 | Erhardt, Jr. | 227/144 |
| 3,826,160 | A * | 7/1974 | Allen et al. | 29/238 |
| 3,874,578 | A * | 4/1975 | Derr et al. | 227/144 |
| 4,070,745 | A * | 1/1978 | Schimmelman | 29/268 |
| 4,109,845 | A * | 8/1978 | Wedge et al. | 227/144 |
| 4,451,999 | A * | 6/1984 | Yvorra | 40/301 |
| 4,729,170 | A * | 3/1988 | Hartmeister | 30/363 |
| 5,010,644 | A * | 4/1991 | Goench | 30/28 |
| 5,307,824 | A * | 5/1994 | Bannett | 132/75.5 |
| 5,323,538 | A * | 6/1994 | Sutterlin | 30/366 |
| 5,651,791 | A * | 7/1997 | Zavlodaver et al. | 606/188 |
| 6,581,293 | B1 * | 6/2003 | Andersen | 30/363 |
| 7,128,751 | B2 * | 10/2006 | Reil | 606/188 |
| 7,571,505 | B2 * | 8/2009 | Hiller | 7/164 |
| 7,955,349 | B2 * | 6/2011 | Reil | 606/188 |
| 2002/0112734 | A1 * | 8/2002 | Rambeau et al. | 132/73 |
| 2006/0217752 | A1 * | 9/2006 | Cho | 606/184 |
| 2007/0021684 | A1 * | 1/2007 | Brielmeier et al. | 600/564 |
| 2007/0181142 | A1 * | 8/2007 | Tufts et al. | 132/73 |
| 2007/0186419 | A1 * | 8/2007 | Sunderland | 30/28 |

FOREIGN PATENT DOCUMENTS

| | | | | |
|---|---|---|---|---|
| GB | 2168920 | A * | 7/1986 | A45D 29/02 |
| WO | WO 2009060488 | A2 * | 5/2009 | |

* cited by examiner

*Primary Examiner* — Vanitha Elgart
(74) *Attorney, Agent, or Firm* — Kenneth L Tolar

(57) ABSTRACT

A fingernail decoration kit includes a pair of pivotally-joined handles that reciprocate in a scissors-like fashion. The handles open and close a pair of jaws that are each configured to releasably retain any one of a plurality of manicuring dies for either shaping or piercing a nail, or crimping a jewelry item thereto.

9 Claims, 3 Drawing Sheets

FINGERNAIL DECORATION KIT

CROSS REFERENCE TO RELATED APPLICATIONS

This application is entitled to the benefit of provisional patent application No. 61/697,963 filed on Sep. 7, 2012, the specification of which is incorporated herein by reference.

BACKGROUND OF THE INVENTION

The present invention relates to a kit for that allows a user to easily shape, pierce and decorate a fingernail.

DESCRIPTION OF THE PRIOR ART

Conventional manicuring tools do not easily pierce, shape or decorate fingernails. Though conventional fingernail files are sometimes used to shape the edge of a fingernail, they are laborious and usually create a nail that is asymmetrical and unsightly. More complicated sculpting techniques, such as scalloping, are even more difficult with a conventional fingernail file.

Accordingly, there is currently a need for a tool that facilitates the shaping and decorating of fingernails. The present invention addresses this need by providing a kit having pliers that manipulate interchangeable dies to shape, pierce and adorn a nail.

SUMMARY OF THE INVENTION

The present invention relates to a fingernail decoration kit comprising a pair of pivotally-joined handles that reciprocate in a scissors-like fashion. The handles open and close a pair of jaws that are each configured to releasably retain any one of a plurality of manicuring dies for either shaping or piercing a nail, or crimping a jewelry item thereto.

It is therefore an object of the present invention to provide a fingernail decoration kit that allows a user to quickly and easily shape, pierce and decorate a fingernail.

It is another object of the present invention to provide a fingernail decoration kit that allows a user to create consistent, uniform decorations on each of a desired number of fingernails.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
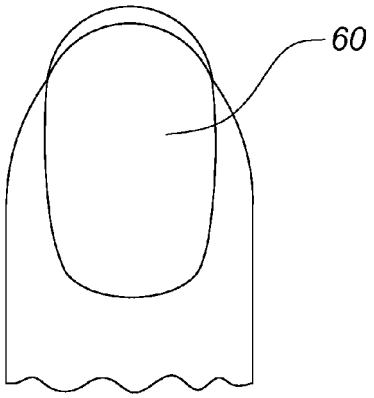
FIG. 1 is a plan view of an exemplary, unadorned fingernail.
Figure 2:
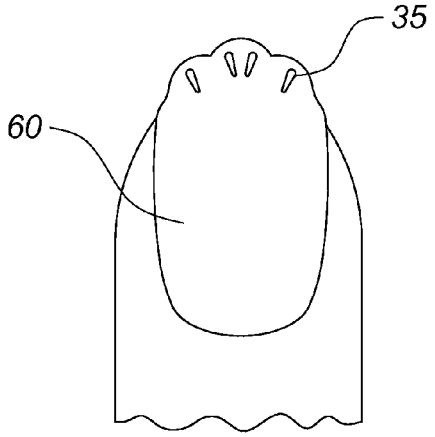
FIGS. 2-4 depict the fingernail of FIG. 1, each decorated using the kit according to the present invention.
Figure 3:
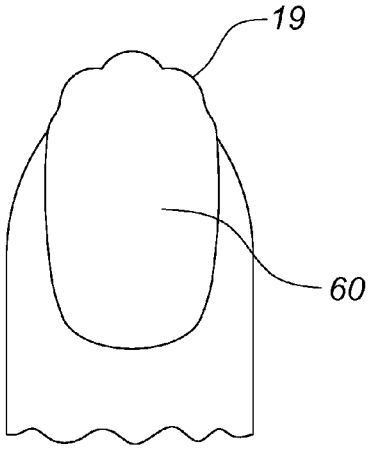
Figure 4:
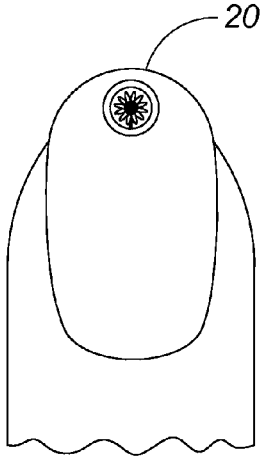
Figure 5:
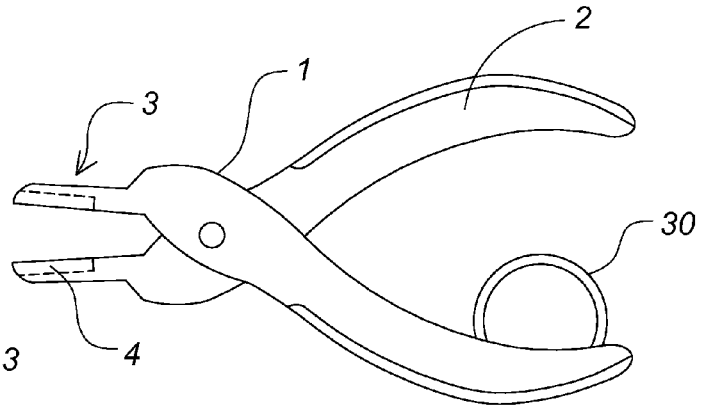
FIG. 5 is an isolated view of the pliers.
Figure 12:
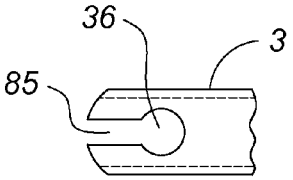
FIG. 12 a plan view of one of the jaws.
Figure 7:
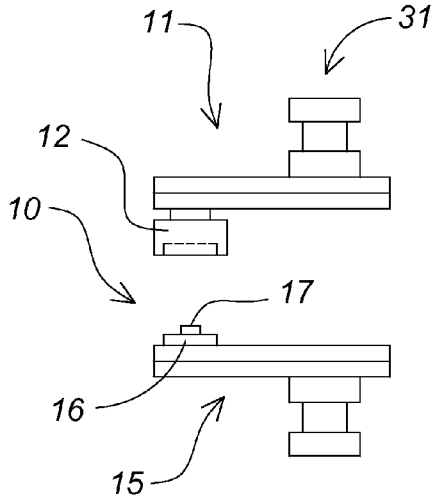
FIG. 7 is an isolated view of the crimping dies.
Figure 6:
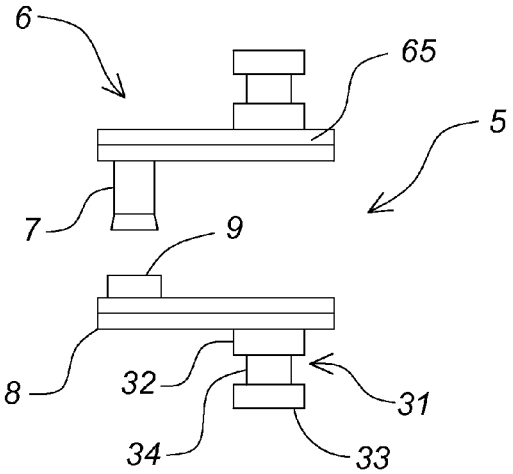
FIG. 6 is an isolated view of the piercing dies.
Figure 13:
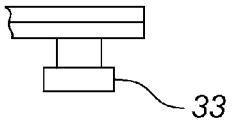
FIG. 13 is a sectional view of a die with the alignment button depressed.
Figure 8:
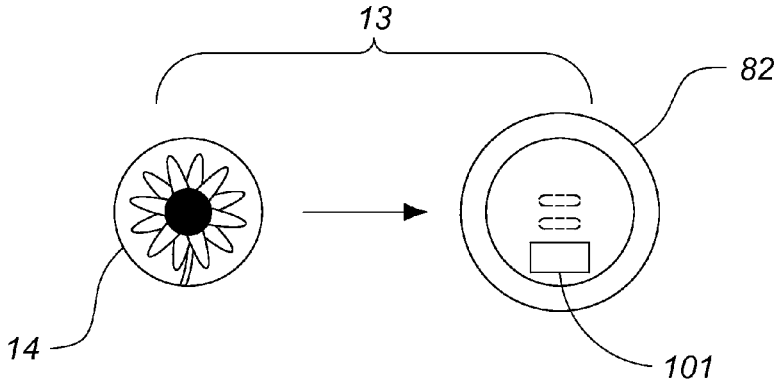
FIG. 8 is an isolated, exploded view of the jewelry item.
Figure 9:
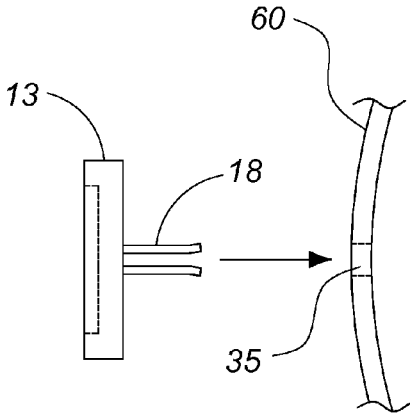
FIG. 9 is a side view of the jewelry item being attached to a fingernail.
Figure 10:
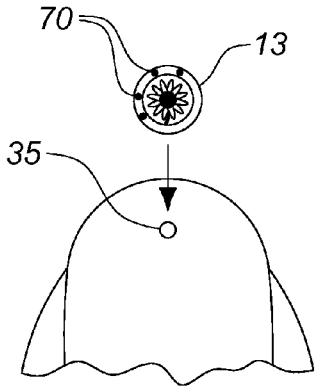
FIG. 10 is a top, plan view of the jewelry item being attached to the fingernail of FIG. 9.
Figure 11:
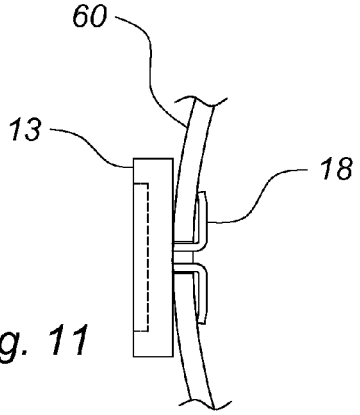
FIG. 11 is a side view of the jewelry item attached to the fingernail of FIG. 9.

The present invention relates to a fingernail decoration kit comprising pliers 1 formed of a pair of pivotally-joined handles 2 that reciprocate in a scissors-like fashion. The handles open and close a pair of jaws 3, each having a channel 4 formed therein for slidably receiving any one of a plurality of manicuring dies. An annular stop member 30 on the inner surface of one of said handles is dimensioned to maintain a minimum, predetermined separation between the handles to prevent over-compression of the dies.

A set of piercing dies 5 can be used to fasten a decorative jewelry item 13, such as a stud, to a fingernail 60. The jewelry item includes a pair of attachment tabs 18 depending from a lower surface that are bent to attach the item to a desired surface. Pulsing LED's 70 may be positioned on an upper surface of the jewelry item to uniquely enhance the fingernail. A microprocessor 101 disables the LED's when an upper section 14 of the jewelry item is rotated.

The piercing dies 5 are configured to create a hole 35 in the fingernail 60 for receiving the attachment tabs 18. An upper piercing die 6 includes a plate 65 having a prong 7 on a lower surface that is dimensioned and configured to form the hole 35 into a desired shape and size. A lower die 8 includes a similar plate having a receptacle 9 on an upper surface that aligns with the prong for receiving the resulting severed nail fragment.

A second set of crimping dies 10 is designed to anchor the decorative jewelry item 13 within the hole created by the piercing dies. An upper die 11 includes a plate with a compartment 12 on a lower surface that is dimensioned and configured to tightly receive the upper end 82 of the jewelry item. A lower die 15 includes an impact head 16 on an upper surface of the plate with a pin 17 extending upwardly therefrom that aligns with a central portion of the compartment 12 when the dies are properly seated within the jaws.

Each plate is slidably retained within the channel 4 of either jaw and includes a spring-biased button 31 thereon that properly aligns the dies. Each button 31 includes an upper disc 32, a lower disc 33 and a shaft 34 therebetween while each jaw includes a slot 85 that extends from a distal end to a circular opening 36. To attach a die, the plate is slid within a jaw channel until the button seats within the opening thereby locking the die to the jaw. To remove the die, the button is depressed until the shaft aligns with the slot to allow the die to easily slide out of the channel. The spring-biased button mechanism assures that the engagement portions of the dies are perfectly aligned when the jaws are attached to assure proper operation.

To create a hole having a desired shape, a user first attaches the piercing dies to the jaws and then places a fingernail therebetween. When the handles are tightly compressed, the prong quickly pierces the fingernail to create a hole 35 therein, and simultaneously forces the resulting fingernail fragment into the receptacle. If the user wishes to also add the jewelry item, he or she substitutes the crimping dies for the piercing dies. The attachment tabs 18 are passed through the hole 35, the compartment 12 is superimposed on the jewelry item and the impact head 16 is placed against the attachment tabs. When the handles are compressed against the jewelry item, the pin separates the tabs while the impact head bends them in opposite directions.

The kit may also include sculpting dies for forming scalloped 19, elliptical 20 or other shaped edges on a fingernail. Preferably, the kit also includes multiple jewelry items, each having unique design elements, themes, colors or other features.

The above-described device is not limited to the exact details of construction and enumeration of parts provided herein. For example, though the piercing die has been primarily depicted and described as creating a circular hole, it can be configured to form an opening having virtually any desired shape. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A fingernail decoration kit comprising:

a pair of pivotally joined handles that reciprocate in a scissors-like fashion, each of said handles having a jaw at an end thereof;

a first piercing die and a second piercing die, said first piercing die and said second piercing die each configured to create a hole in a fingernail when said handles are compressed and said fingernail is positioned between said first die and said second die, wherein said first piercing die includes a prong on a lower surface that is dimensioned and configured to form the hole into a discrete shape and size, and wherein said second die includes a receptacle on an upper surface for receiving a severed nail fragment created by said prong;

means for removably attaching the first piercing die to the jaw on one of said handles;

means for removably attaching the second piercing die to the jaw on another of said handles.

2. The fingernail decoration kit according to claim 1 further comprising a jewelry item having a pair of attachment tabs extending therefrom that pass through said hole to secure said jewelry item to said fingernail.

3. The fingernail decoration kit according to claim 2 further comprising a pair of crimping dies for anchoring the jewelry item within said hole, wherein a first of said crimping dies includes a compartment on a lower surface that is configured to tightly receive an upper end of the jewelry item, and wherein a second of said crimping dies includes an impact head on an upper surface with a pin extending upwardly therefrom that aligns with said compartment, whereby, when said handles are compressed, the pin separates said attachment tabs while said impact head bends said attachment tabs in opposite directions;

means for removably attaching the first of said crimping dies to the jaw on one of said handles;

means for removably attaching the second of said crimping dies to the jaw on another of said handles.

4. The fingernail decoration kit according to claim 1 wherein one of said handles includes an annular stop member on an inner surface that is dimensioned to maintain a minimum, predetermined separation between said handles to prevent over-compression of said first die and said second die.

5. The fingernail decoration kit according to claim 3 wherein said jewelry item includes pulsing LEDs.

6. The fingernail decoration kit according to claim 1 further comprising a means for aligning said prong and said receptacle when the first piercing die is attached to the jaw on one of said handles and the second piercing die is attached to the jaw on another of said handles.

7. The fingernail decoration kit according to claim 6 wherein said means for aligning said prong with said receptacle comprises:

a spring-biased button on said first piercing die and said second piercing die;

a slot extending from a distal end of the jaw to an opening for receiving said button.

8. The fingernail decoration kit according to claim 6 wherein said means for aligning said prong with said receptacle comprises:

a depressible spring-biased button on said first piercing die and said second piercing die;

a first slot extending from a distal end of the jaw on one of said handles to a circular opening;

a second slot extending from a distal end of the jaw on another of said handles to a circular opening, whereby either of the first piercing die and the second piercing die is slid within either of the first slot and the second slot until the button seats within the opening thereby locking the die to the jaw, and whereby the button is depressed until the button unseats from the opening to allow the die to easily slide out of the slot.

9. The fingernail decoration kit according to claim 5 wherein said jewelry item includes a microprocessor that disables the LEDs when an upper section of the jewelry item is rotated.

* * * * *